US007431067B2

(12) United States Patent
Nien

(10) Patent No.: US 7,431,067 B2
(45) Date of Patent: Oct. 7, 2008

(54) TRAVERSE-TYPE WINDOW BLIND WITH MULTIPLE RODS AND BLINDS

(76) Inventor: Leslie Nien, No. 45-4, Fan Po St., Fu Hsing, Hsiang, Changhua Hsien (TW)

( * ) Notice: Subject to any disclaimer, the term of this patent is extended or adjusted under 35 U.S.C. 154(b) by 422 days.

(21) Appl. No.: 11/193,497

(22) Filed: Aug. 1, 2005

(65) Prior Publication Data

US 2006/0260769 A1 Nov. 23, 2006

(30) Foreign Application Priority Data

May 20, 2005 (TW) ..... 94208228 U

(51) Int. Cl.
*A47H 1/00* (2006.01)

(52) U.S. Cl. ..... 160/126; 16/87 R; 16/96 D

(58) Field of Classification Search ..... 160/126, 160/125, 123, 330, 333; 16/96 D, 87 R, 87.2, 16/87.8; 248/263; 211/105.1
See application file for complete search history.

(56) References Cited

U.S. PATENT DOCUMENTS 533,152 A * 1/1895 Wheat ..... 160/330
668,923 A * 2/1901 Muehlebach ..... 160/330
795,039 A * 7/1905 Hoffmann ..... 160/330
1,216,271 A * 2/1917 Behl ..... 160/128
7,111,336 B1 * 9/2006 Lai ..... 4/576.1
7,237,303 B2 * 7/2007 Schorling ..... 16/87.2
7,243,822 B2 * 7/2007 Presser et al. ..... 223/85
7,293,596 B2 * 11/2007 Nien ..... 160/89
2003/0028998 A1 * 2/2003 Samelson ..... 16/87 R
2005/0022950 A1 * 2/2005 Putman ..... 160/330
2006/0021722 A1 * 2/2006 Nien ..... 160/330

* cited by examiner

*Primary Examiner*—Blair M. Johnson
(74) *Attorney, Agent, or Firm*—Troxell Law Office, PLLC

(57) ABSTRACT

A traverse-type window blind with multiple rods and blinds includes brackets, support rods, sliding hooks, and blind bodies wherein each bracket has an abutment face to be fixed to a sidewall of a window frame and at least two or more support portions sequentially arranged at the other side for the mounting of the support rods thereon respectively. Each sliding hook has a hooked upper portion larger than the support portion thereof to be guided through traverse spaces defining the support portions and hanged onto the support rod thereby so that each blind body suspending between every two sliding hooks can be synchronically moved along the support rod without being interfered in an easy traverse-type operation. Besides, each sliding hook has a protective member mounted to the hooked upper portion so as to avoid direct contact with the surface of the support rod and refrain from any damages caused thereby.

14 Claims, 7 Drawing Sheets

TRAVERSE-TYPE WINDOW BLIND WITH MULTIPLE RODS AND BLINDS

BACKGROUND OF THE INVENTION

The present invention is related to a traverse-type window blind with multiple rods and blinds, including brackets, support rods, sliding hooks, and blind bodies wherein each bracket has at least two or more support portions sequentially extending forwards at one side of an abutment face for the mounting of the support rods thereon respectively, and each sliding hook is equipped with a hooked upper portion larger than the support portion thereof so that the sliding hook can freely run on the support rod and move among traverse spaces defining the support portions of the brackets without being interfered in the operation thereof. Therefore, each blind body suspending between every two sliding hooks thereof can be precisely moved along the support rod relative to the position of sunlight to achieve accurate sunlight blocking effect thereby.

Please refer to FIG. 1. A conventional window blind with multiple rods and blinds includes a plurality of brackets 10 each made up of an abutment face 11 with thru-holes 111 disposed thereon to be fixedly locked to one sidewall of a window frame, and a support decorative body 12 with front and rear engaging holes 121 sequentially arranged thereon extending forwards in perpendicular to the abutment face 11 thereof. Two support rods 20 are respectively mounted to the front and rear engaging holes 121 of each bracket 10 and spaced out in distance for the suspending of blind bodies 30 thereon respectively wherein the blind bodies 30 can be parted or drawn from both left and right sides in the opening or closing operation thereof.

However, there are some drawbacks to such conventional window blind structure. Most of all, the two support rods 20 are directly led through the front and rear engaging holes 121 of the brackets 10 and fixedly mounted thereto. When the blind bodies 20 are actuated in the opening or closing operation thereof, the support decorative bodies 12 can easily get in the way and interfere the operation thereof. As a result, the blind bodies 20 can be simply parted or drawn from both left and right sides in operation instead of freely moved relative to the position of sunlight to block the sunlight thereby. Thus, the conventional window blind with multiple rods and blinds thereof is very inconvenient in application thereof.

SUMMARY OF THE PRESENT INVENTION

It is, therefore, the primary purpose of the present invention to provide a traverse-type window blind with multiple rods and blinds, including brackets, support rods, sliding hooks, and blind bodies wherein each bracket has at least two or more support portions sequentially extending forwards at one side of an abutment face for the mounting of the support rods thereon respectively, and each sliding hook is equipped with a hooked upper portion larger than the support portion thereof so that the sliding hook can freely run on the support rod and move among traverse spaces defining the support portions of the brackets without being interfered in the operation to provide an easy traverse-type design thereby. Therefore, each blind body suspending between every two sliding hooks thereof can be precisely moved along the support rod relative to the position of sunlight to achieve accurate sunlight blocking effect thereby.

It is, therefore, the second purpose of the present invention to provide a traverse-type window blind with multiple rods and blinds wherein a protective member is mounted to the hooked upper portion of each sliding hook therein to separate the sliding hook from the support rod thereof so that the sliding hook running on the support rod thereof is prevented from directly rubbing against the surface of the support rod and causing any scratching damages thereon, achieving the purpose of protection and the durability of the present invention in application.

It is, therefore, the third purpose of the present invention to provide a traverse-type window blind with multiple rods and blinds wherein a pull rod is fixed to an appropriate position at the lower section of the sliding hook so that the pull rod is simply drawn to synchronically actuate the movement of the sliding hooks and a hanging rod with the blind body attached thereto in a linkage operation without directly contacting the blind body so as to avoid any partial untidy stains or marks left thereon in the operation thereof, achieving the best state of application thereof.

DETAILED DESCRIPTION OF THE PREFERRED EMBODIMENTS

Figure 1:
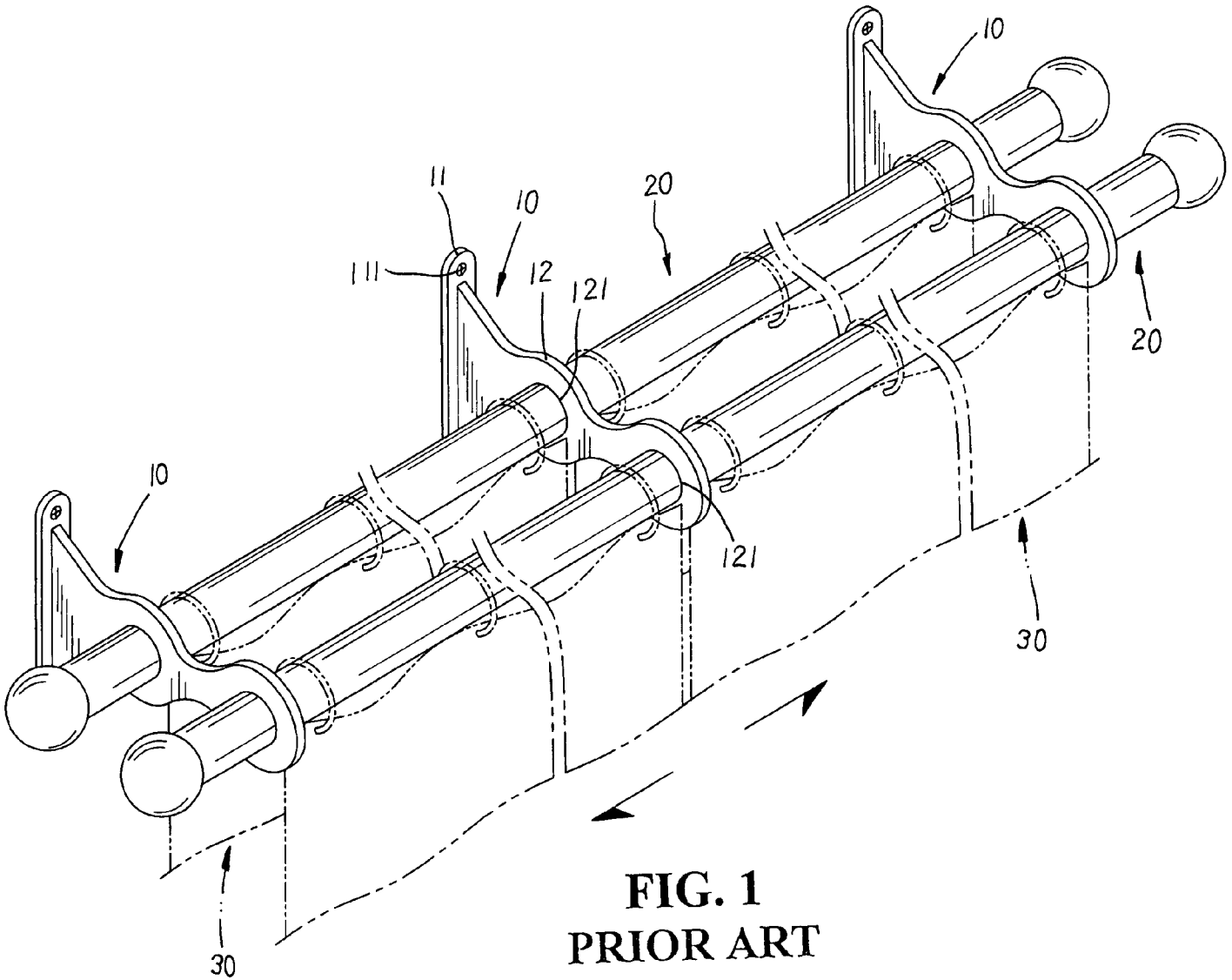
FIG. 1 PRIOR ART
FIG. 1 is a diagram showing a conventional window blind with multiple rods and blinds in application thereof.
Figure 2:
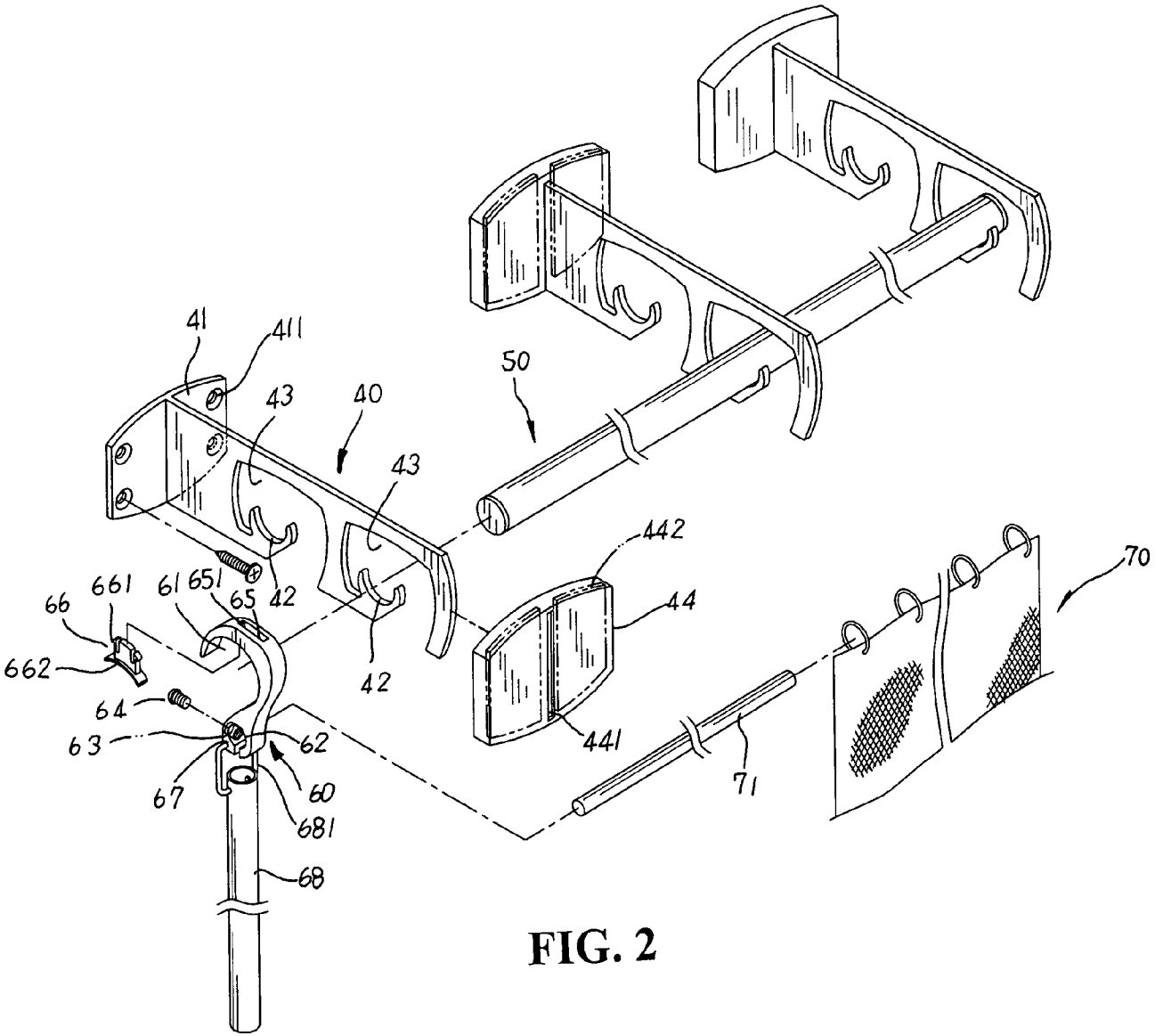
FIG. 2 is an exploded perspective view of the present invention.
Figure 3:
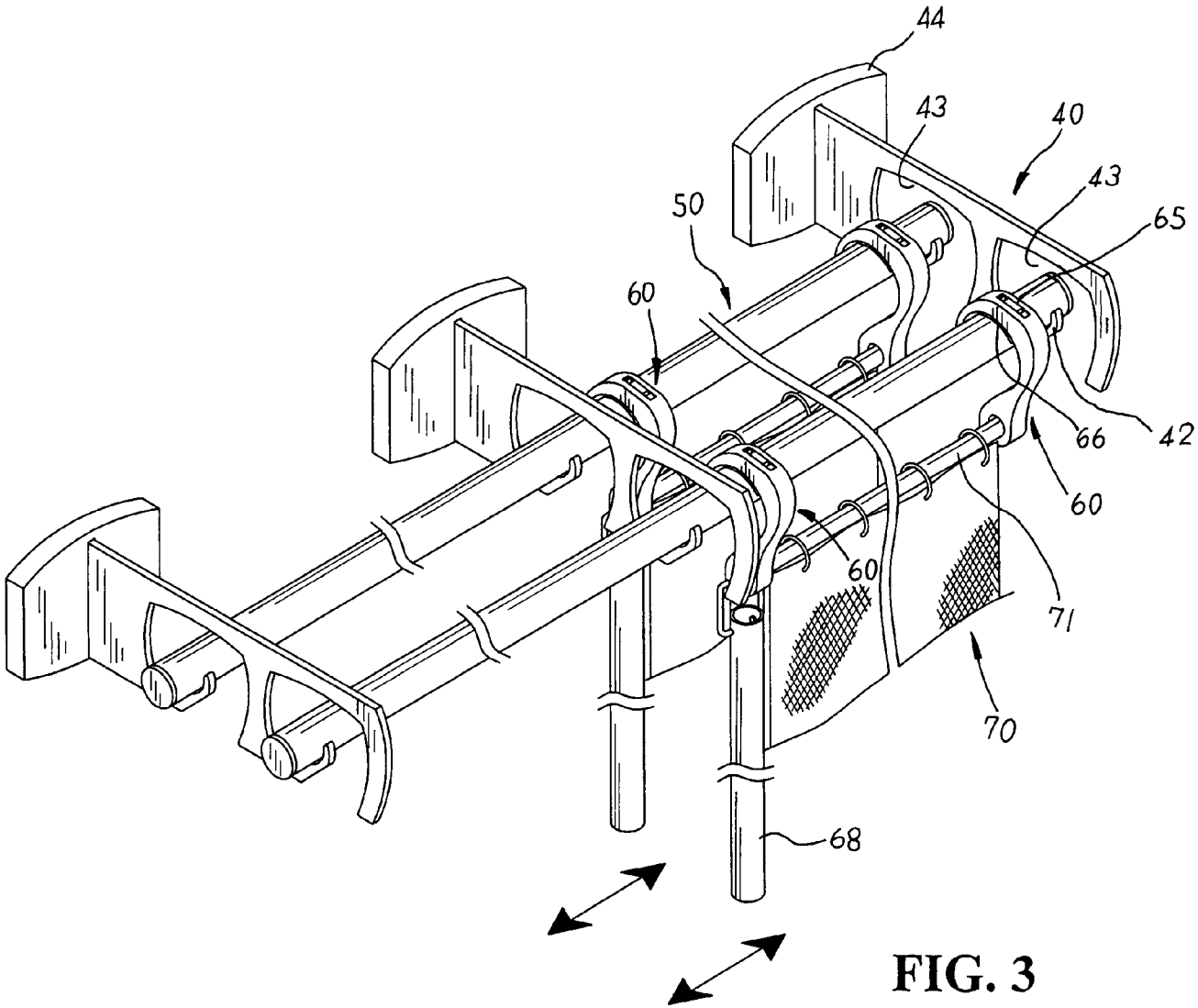
FIG. 3 is an assembled perspective view of the present invention in operation.
Figure 4:
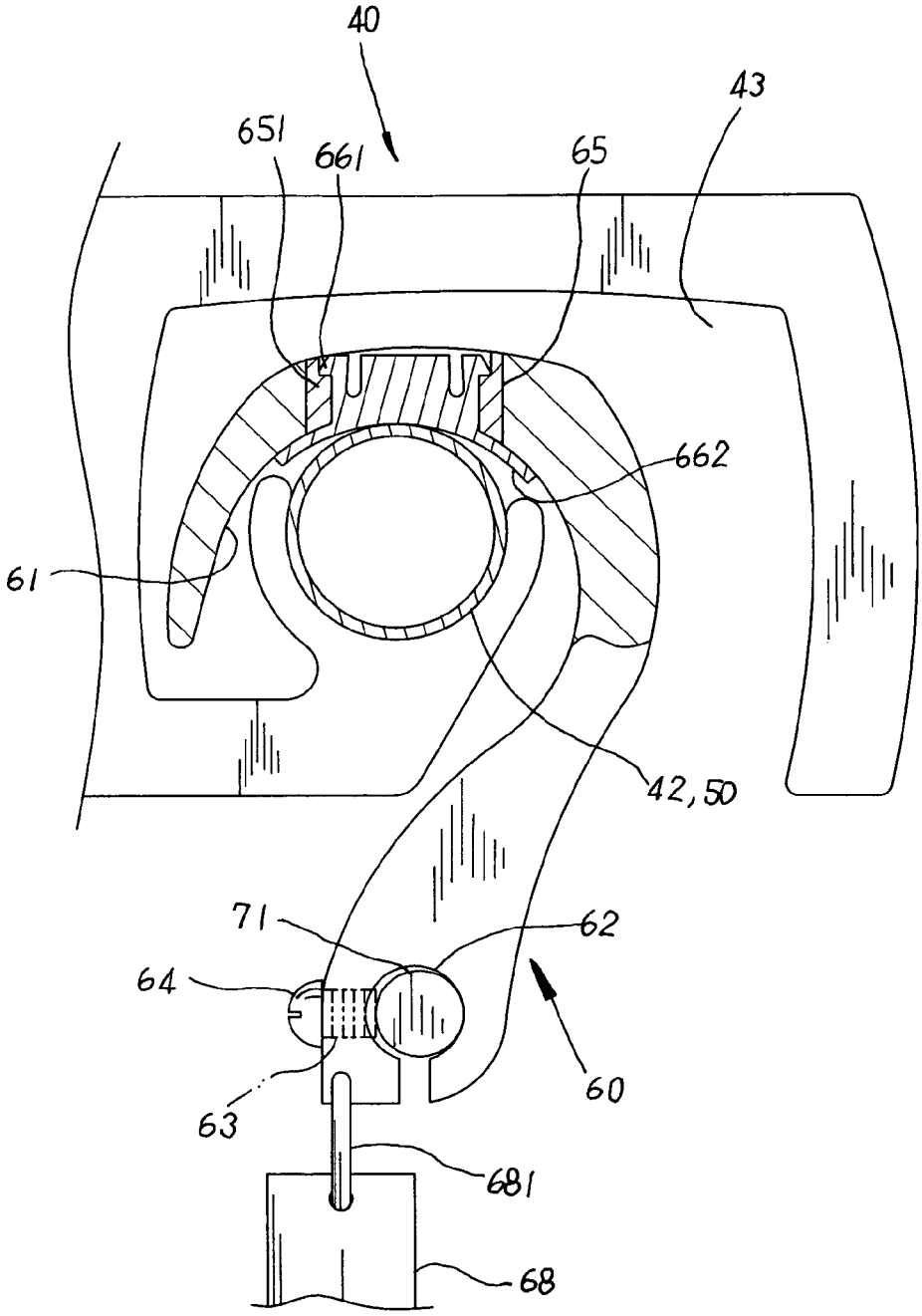
FIG. 4 is an assembled cross sectional view of a bracket, a sliding hook, and a support rod of the present invention.

Please refer to FIGS. 2, 3. The present invention is related to a traverse-type window blind with multiple rods and blinds, including brackets 40, support rods 50, sliding hooks 60, and blind bodies 70. Each bracket 40 has an abutment face 41 with thru-holes 411 disposed at one side thereon to be fixedly locked to a sidewall of a window frame thereby, and at least two or more front and rear support portions 42 each having an arcuate support surface defining thereon are sequentially arranged in an equal space to extend forwards at one side of the abutment face 41 for the mounting of the support rods 50 thereon respectively. The outer periphery of each support portion 42 is defined by an inverted U-shaped traverse space 43, and a decorative cover 44 is provided to apply to the outer side of the abutment face 41 thereon, permitting an even and neat look of the bracket 40 thereby. The decorative cover 44 identically shaped like the abutment face 441 thereof has a passable slot 441 disposed in the middle thereon to thread through the support portions 42 thereby, and a pair of magnetic attachment articles 442 symmetrically fixed at both sides thereof to be magnetically attached to the abutment face 41 for location thereon. Each sliding hook 60 (referring to FIG. 4) is made up of a hooked upper portion 61 shaped in a hooked curvature larger than that of the support portion 42 to be led through the traverse space 43 thereof and hanged onto the support rod 50 thereby. The lower section of the sliding hook 60 is disposed a sleeve hole 62 for the location of each end of a hanging rod 71 with one blind body 70 mounted thereto, permitting each blind body 70 to precisely suspend and hang between every two sliding hooks 60 thereby. At one peripheral wall of the sleeve hole 62 thereof is perpendicularly disposed a screw hole 63 for the locking of a screw 64 there-through to abut tight against the circumferential surface of the hanging rod 71 thereon, and at the top side of the hooked upper portion 61 is equipped with a slot-like assembly section 65 with a stepwise stop flange 651 disposed therein to be reciprocally coupled with a plastic protective member 66 thereby. The protective member 66 has a set of insert hooks 661 protruding at the top thereof to precisely engage with the stop flange 651 of the assembly section 65 and form an even and flat surface therewith, and an arcuate sliding surface 662 is disposed defining the bottom side of the protective member 66 to accurately abut against the inner wall of the hooked upper portion 61 thereof and contact with the circumferential surface of the support rod 50 thereby. Beneath the screw hole 63 of the sliding hook 60 thereof is disposed a fixing hole 67 for the suspending location of a hanging ring 681 with a pull rod 68 attached thereto.

In application, the hooked upper portion 61 of the sliding hook 60 larger than the support portion 42 of the bracket 40 can freely pass through the traverse space 43 thereof (referring to FIG. 4), permitting the sliding hook 60 to slide along the support rod 50 and move among the traverse spaces 43 and the support portions 42 of the brackets 40 without being interfered in the operation thereof to provide an easy traverse-type design thereby. Therefore, the blind body 70 suspending on each hanging rod 50 can be freely moved and accurately shifted in position relative to that of sunlight to achieve better sunlight blocking effect thereby. Meanwhile, the pull rod 68 is simply drawn to synchronically actuate the movement of the sliding hooks 60, the hanging rod 71 and the blind body 70 in a linkage operation, preventing any direct and repeated contact with the blind body 70 so as to avoid partial untidy stains or marks left thereon in the operation thereof. Besides, the protective member 66 is applied to separate each sliding hook 60 from the support rod 50 thereof to prevent the sliding hook 60 running on the support rod 50 thereof from directly rubbing against the surface of the support rod 50 and causing scratching damages thereon, efficiently achieving the purpose of protection and the durability of the present invention in application thereof.

Figure 5:
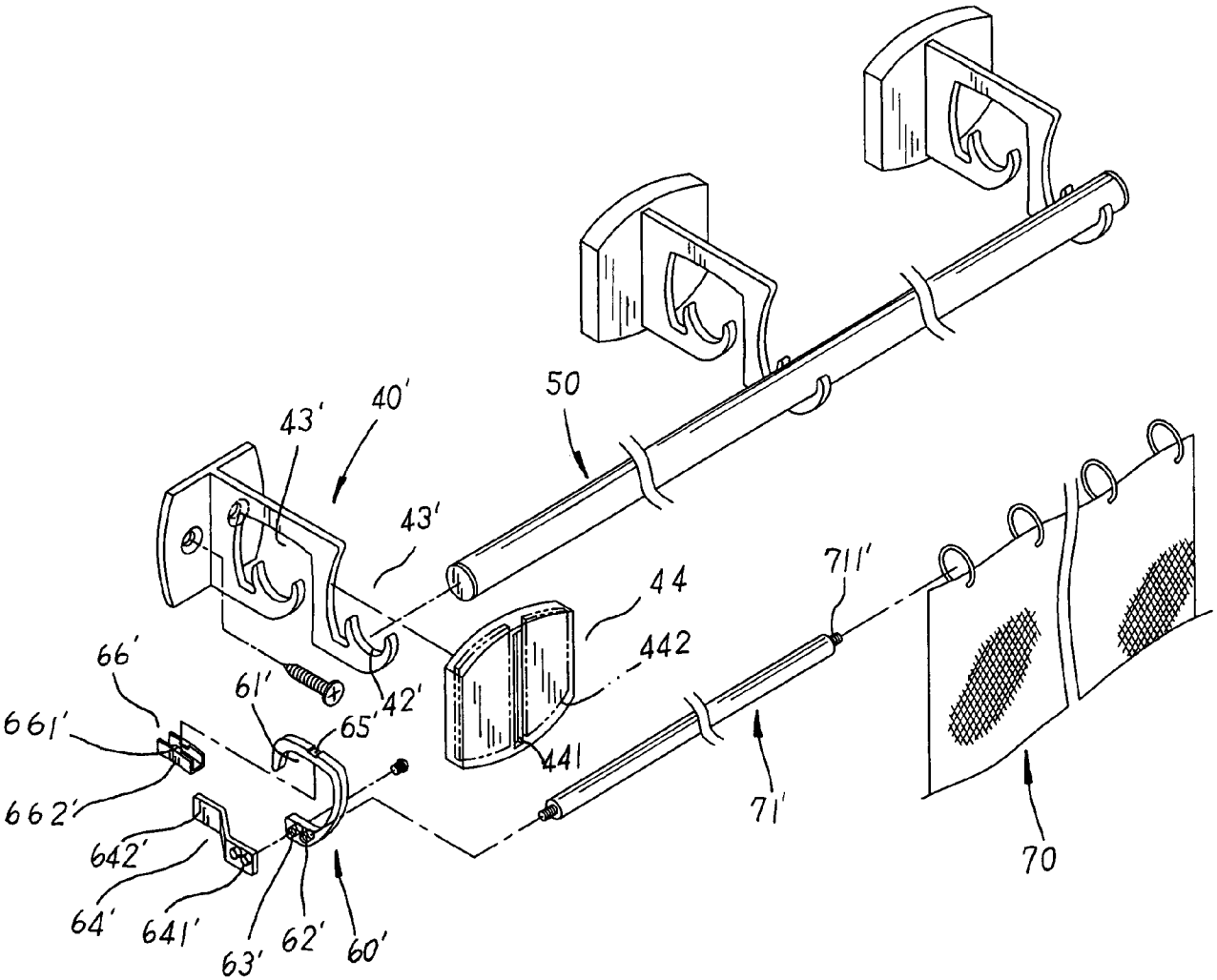
FIG. 5 is an exploded perspective view of another embodiment of the present invention.
Figure 6:
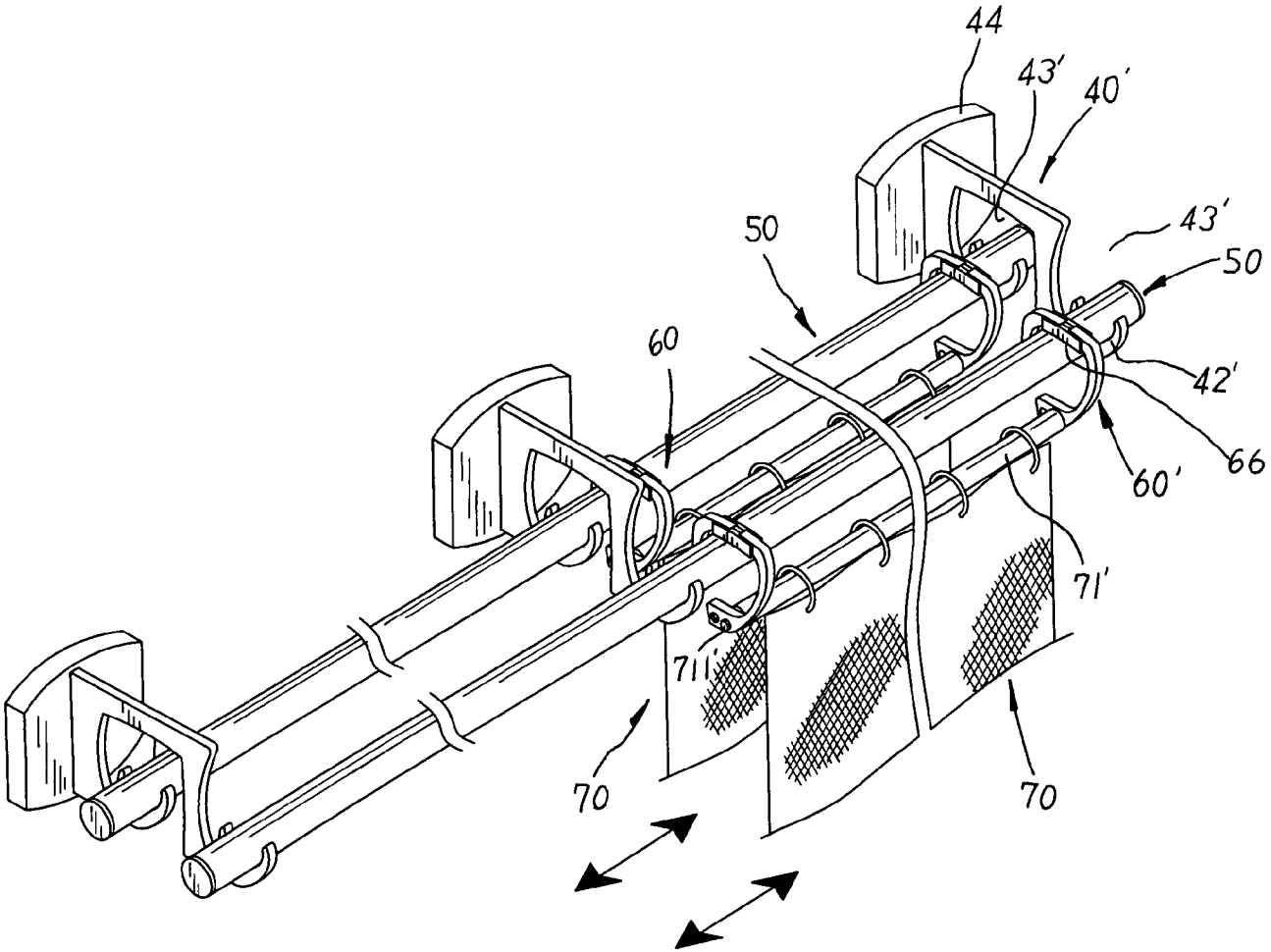
FIG. 6 is an assembled perspective and operational view of the present invention as shown in FIG. 5.
Figure 7:
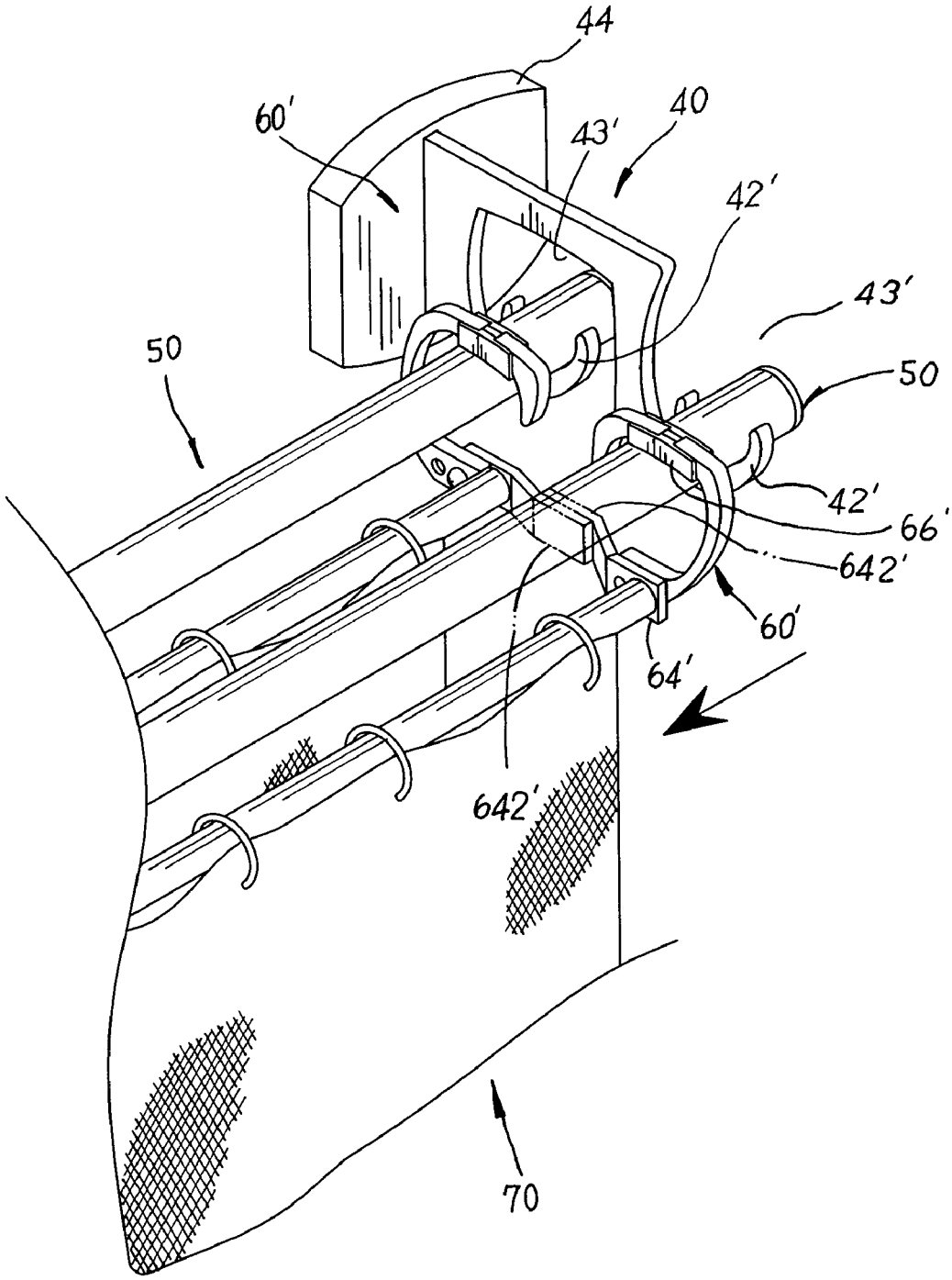
FIG. 7 is another operational view of the present invention as shown in FIG. 5.

Please refer to FIG. 5 showing an exploded perspective view of another embodiment of the present invention. The present invention can also be made up of brackets 40' each having an outermost support portion 42' defined by an open-type traverse space 43', and an innermost support portion 42' defined by a narrower traverse space 43'. And, sliding hooks 60' are provided each made into a thin-plate form with a size adapted to that of the traverse space 43' and the support portions 42' thereof. The sliding hook 60' is equipped with a hooked upper portion 61' larger than the support portion 42' to be guided through the traverse space 43' and hanged onto the support rod 50 thereby. At the top side of each sliding hook 60' thereof is mounted a plastic and U-shaped protective member 66', and a U-shaped assembly section 65' is disposed at an appropriate position of the hooked upper portion 61' therein for insert ribs 661' symmetrically extending at the top edge of the protective member 66' thereof to precisely engage and form an even and flat surface therewith. The bottom side of the protective member 66' is defined by an arctuate sliding surface 662' to abut against the inner wall of the hooked upper portion 61' and contact with the circumferential surface of the support rod 50 thereby. The sliding hook 60' also includes a set of first and second screw holes 62', 63' horizontally arranged in an equal space at the lower section thereon. And hanging rods 71' are provided each having fixing ends 711' disposed at both sides thereon to be securely locked to the first screw hole 62' of a sliding hook 60' respectively, permitting the blind body 70 attached to each hanging rod 71' thereon to precisely suspend and hang between every two sliding hooks 60' thereby. Therefore, the hooked upper portions 61' of the sliding hooks 60' can freely run on the support rod 50 without being interfered by the bracket 40' as shown in FIG. 6. In addition, a linkage plate 64' with a plurality of assembly holes 641 disposed thereon is reciprocally locked to the second screw hole 63' thereof for location thereon, and one end of the linkage plate 64' is bent into an appropriate angle and extend for a proper length to provide a push guiding portion 642'. Then, the sliding hooks 60' of paired-up support rods 50 are symmetrically hanged in opposite directions, permitting the push guiding portions 642' of the corresponding linkage plates 64' to precisely overlap in pairs. Therefore, the blind body 70 mounted to one of the paired-up support rods 50 thereof is drawn to actuate the synchronic movement of the other blind body 70 mounted to the other paired-up support rod 50 as shown in FIG. 7.

What is claimed is:

1. A traverse-type window blind with multiple rods and blinds, comprising:

brackets, support rods, sliding hooks, and blind bodies wherein each bracket has an abutment face with thru-holes disposed at one side thereon to be fixedly locked to a sidewall of a window frame thereby;

the bracket having at least two or more support portions sequentially arranged and extending forwards at the other side thereon for the mounting of the support rods thereon respectively wherein each support portion has a traverse space defining therein;

each sliding hook being made up of a hooked upper portion larger than the support portion of the bracket to be led through the traverse space thereof and hanged onto the support rod thereby, permitting the sliding hook to freely run on the support rod and move among the support portions and the traverse spaces of the brackets without being interfered in the process to provide an easy traverse-type operation thereof; besides, at the top side of the hooked upper portion of each sliding hook is mounted a protective member to separate the sliding hook from the support rod so that the sliding hook running on the support rod is prevented from directly rubbing against the surface of the support rod and causing any scratching damages thereon, each blind body being attached to a hanging rod with both ends thereof respectively fixed to one sliding hook, permitting the blind body to precisely suspend between every two sliding hooks and synchronically move along with the sliding hooks in operation thereof, wherein the protective member is equipped with a set of insert hooks protruding at the top thereof, which mount the protective member to the hooked upper portion by engaging a slot in the hooked upper portion and an arcuate sliding surface defining the bottom side thereon to abut against the inner wall of the hooked upper portion of the sliding hook and contact with the circumferential surface of the support rod thereby.

2. The traverse-type window blind with multiple rods and blinds as claimed in claim 1, wherein at the top side of each sliding hook is disposed an assembly section with a stepwise stop flange defined therein.

3. The traverse-type window blind with multiple rods and blinds as claimed in claim 1, wherein the protective member is made of plastic materials.

4. The traverse-type window blind with multiple rods and blinds as claimed in claim 1, wherein the sliding hook has a sleeve hole disposed at the lower section thereon for the mounting location of each end of the hanging rod thereto, and a screw hole perpendicularly disposed at one peripheral wall of the sleeve hole thereon for the registration of a screw therewith to abut tight against the circumferential surface of the hanging rod thereby.

5. The traverse-type window blind with multiple rods and blinds as claimed in claim 4, wherein beneath the screw hole of the sliding hook is appropriately disposed a fixing hole for the suspending location of a hanging ring with a pull rod attached thereto.

6. The traverse-type window blind with multiple rods and blinds as claimed in claim 1, wherein the innermost traverse space of each bracket thereof is made into a narrower shape, and the sliding hook thereof is made into a thin plate form with a size adapted to that of the traverse spaces and the support portions thereof.

7. The traverse-type window blind with multiple rods and blinds as claimed in claim 1, wherein the top side of the sliding hook has a U-shaped and groove-like assembly section defining thereon.

8. The traverse-type window blind with multiple rods and blinds as claimed in claim 1, wherein the protective member has a set of insert ribs symmetrically extending at the top edge thereon, and an arcuate sliding surface defining the bottom side thereon to abut against the inner wall of the hooked upper portion of the sliding hook and contact with the circumferential surface of the support rod thereby.

9. The traverse-type window blind with multiple rods and blinds as claimed in claim 6, wherein each sliding hook has a set of first and second screw holes horizontally arranged in an equal space at the lower section thereon, and a hanging rod with fixing ends disposed at both sides thereon is provided to lock to the first screw hole of a sliding hook respectively.

10. A traverse-type window blind with multiple rods and blinds, comprising:

brackets, support rods, sliding hooks, and blind bodies wherein each bracket has an abutment face with thru-holes disposed at one side thereon to be fixedly locked to a sidewall of a window frame thereby;

the bracket having at least two or more support portions sequentially arranged and extending forwards at the other side thereon for the mounting of the support rods thereon respectively wherein each support portion has a traverse space defining therein;

each sliding hook being made up of a hooked upper portion larger than the support portion of the bracket to be led through the traverse space thereof and hanged onto the support rod thereby, permitting the sliding hook to freely run on the support rod and move among the support portions and the traverse spaces of the brackets without being interfered in the process to provide an easy traverse-type operation thereof; besides, at the top side of the hooked upper portion of each sliding hook is mounted a protective member to separate the sliding hook from the support rod so that the sliding hook running on the support rod is prevented from directly rubbing against the surface of the support rod and causing any scratching damages thereon, each blind body being attached to a hanging rod with both ends thereof respectively fixed to one sliding hook, permitting the blind body to precisely suspend between every two sliding hooks and synchronically move along with the sliding hooks in operation thereof, wherein the innermost traverse space of each bracket thereof is made into a narrower shape, and the sliding hook thereof is made into a thin plate form with a size adapted to that of the traverse spaces and the support portions thereof, wherein each sliding hook has a set of first and second screw holes horizontally arranged in an equal space at the lower section thereon, and a hanging rod with fixing ends disposed at both sides thereon is provided to lock to the first screw hole of a sliding hook respectively, wherein the second screw hole of each sliding hook is locked to a linkage plate having a plurality of assembly holes disposed thereon.

11. The traverse-type window blind with multiple rods and blinds as claimed in claim 10, wherein one end of the linkage plate is bent into an appropriate angle and extended for a proper length to provide a push guiding portion thereon, permitting the push guiding portions of the linkage plates extending at every paired-up support rods to precisely overlap so that the blind body mounted to one of the paired-up support rods thereof is drawn to actuate the synchronic movement of the blind body mounted to the other paired-up support rod in a linkage operation thereof.

12. The traverse-type window blind with multiple rods and blinds as claimed in claim 1, wherein the support portions each having an arcuate support surface defining thereon are sequentially arranged and equidistantly spaced out from the rear to the front at one side of each bracket thereon.

13. The traverse-type window blind with multiple rods and blinds as claimed in claim 1, wherein a decorative cover is provided to apply to the abutment face of the bracket thereon.

14. A traverse-type window blind with multiple rods and blinds, comprising:

brackets, support rods, sliding hooks, and blind bodies wherein each bracket has an abutment face with thru-holes disposed at one side thereon to be fixedly locked to a sidewall of a window frame thereby;

the bracket having at least two or more support portions sequentially arranged and extending forwards at the other side thereon for the mounting of the support rods thereon respectively wherein each support portion has a traverse space defining therein;

each sliding hook being made up of a hooked upper portion larger than the support portion of the bracket to be led through the traverse space thereof and hanged onto the support rod thereby, permitting the sliding hook to freely run on the support rod and move among the support portions and the traverse spaces of the brackets without being interfered in the process to provide an easy traverse-type operation thereof; besides, at the top side of the hooked upper portion of each sliding hook is mounted a protective member to separate the sliding hook from the support rod so that the sliding hook running on the support rod is prevented from directly rubbing against the surface of the support rod and causing any scratching damages thereon, each blind body being attached to a hanging rod with both ends thereof respectively fixed to one sliding hook, permitting the blind body to precisely suspend between every two sliding hooks and synchronically move along with the sliding hooks in operation thereof, wherein a decorative cover is provided to apply to the abutment face of the bracket thereon, wherein the decorative cover identically shaped like the abutment face of the bracket is equipped with a passable slot disposed in the middle to thread through the support portions of each bracket thereby, and a pair of magnetic attachment articles symmetrically fixed at both sides thereof to be magnetically attached to the abutment face of the bracket for location thereon.

* * * * *